US006576844B1

(12) United States Patent
Kamata

(10) Patent No.: US 6,576,844 B1
(45) Date of Patent: Jun. 10, 2003

(54) HIGH-STRENGTH LIGHT-WEIGHT CONDUCTOR AND TWISTED AND COMPRESSED CONDUCTOR

(75) Inventor: Takeshi Kamata, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/676,491

(22) Filed: Oct. 2, 2000

(30) Foreign Application Priority Data

Sep. 30, 1999 (JP) ..... 11-279273
Feb. 4, 2000 (JP) ..... 2000-027103

(51) Int. Cl.[7] ..... H01B 5/00; H01B 5/08; H01B 7/18

(52) U.S. Cl. ..... 174/126.1; 174/126.2; 174/128.1; 174/128.2; 174/108

(58) Field of Search ..... 174/128.1, 128.2, 174/126.1, 126.2, 36, 102 R, 102 A, 103, 106 R, 108

(56) References Cited

U.S. PATENT DOCUMENTS

| | | | | | |
|---|---|---|---|---|---|
| 3,647,939 | A | * | 3/1972 | Schoerner | 174/128 |
| 5,171,941 | A | * | 12/1992 | Shimizu et al. | 174/125.1 |
| 5,198,621 | A | * | 3/1993 | Kojima | 174/128.1 |
| 5,929,385 | A | * | 7/1999 | Sugimoto et al. | 174/125.1 |
| 6,245,425 | B1 | * | 6/2001 | McCullough et al. | 428/379 |

FOREIGN PATENT DOCUMENTS

| | | | | |
|---|---|---|---|---|
| GB | 197692 | * | 5/1922 | |
| JP | 04-308611 A | * | 10/1992 | H01B/05/10 |
| JP | 4-334629 | | 11/1992 | B60M/1/30 |
| JP | 06-005130 A | * | 1/1994 | H01B/12/10 |
| JP | 06-199830 A | * | 4/1994 | H01B/12/08 |
| JP | 6-235023 | | 8/1994 | C21D/8/06 |
| JP | 71-05761 A | * | 4/1995 | H01B/13/00 |
| JP | 8-109422 | | 4/1996 | C22C/1/05 |
| JP | 8-124426 | | 5/1996 | H01B/7/00 |
| JP | 8-199306 | | 8/1996 | C22C/38/00 |
| JP | 9-45139 | | 2/1997 | H01B/5/10 |
| JP | 10-110245 | | 4/1998 | C22C/38/00 |
| US | WO 95/27911 A | * | 10/1995 | H01B/12/00 |
| US | WO 98/13859 A | * | 4/1998 | |

OTHER PUBLICATIONS

English Language Abstract JP6235023 Aug. 8, 1994.
English Language Abstract JP8109422 Apr. 30, 1996.
English Language Abstract JP8124426 May 17, 1996.
English Language Abstract JP8199306 Aug. 6, 1996.
English Language Abstract JP9045139 Feb. 14, 1997.
English Language Abstract JP10110245 Apr. 28, 1998.

* cited by examiner

*Primary Examiner*—Dean A. Reichard
*Assistant Examiner*—William H. Mayo, III
(74) *Attorney, Agent, or Firm*—Sughrue Mion, PLLC

(57) ABSTRACT

A twisted and compressed conductor including a central wire and a plurality of conductor wires concentrically twisted around the central wire, wherein the central wire is at least one high-strength wire made of a fiber-reinforced metal matrix composite.

4 Claims, 4 Drawing Sheets

HIGH-STRENGTH LIGHT-WEIGHT CONDUCTOR AND TWISTED AND COMPRESSED CONDUCTOR

BACKGROUND OF INVENTION

1. Field of Invention

This invention relates to a high-strength light-weight conductor and a twisted and compressed conductor which are used in power transmission lines, etc. and a reinforcing wire used therein.

2. Description of Prior Art

Twisted conductors are widely used in the fields from power cables to low-tension wires of electronic equipment. Among the fields is application where twisted conductors are required to be of high strength and light weight. For example, a high-strength light-weight twisted conductor, where used in power cables, will allow extension of the distance between pylons or greatly reduce wire breakage in the strong wind.

In the field of automobiles, a high-strength light-weight twisted conductor will enable reduction of a wire harness diameter and also completely prevent accidental wire breakage during routing.

To meet the above demand, various alterations to the composition of copper alloys constituting the conductor have been studied but have not achieved satisfactory results in performance and cost.

As another approach, it has been proposed to use twisted music wires (hard drawn steel wires) as a reinforcing core around which conductor wires of copper, aluminum, etc. are arranged to obtain a high-strength light-weight twisted conductors.

However, such a high-strength light-weight twisted conductor is susceptible to corrosion because of the steel wire. Further, the conductor suffers from a core loss due to the AC resistance by the skin effect, resulting in power transmission loss. Furthermore, where it is applied to low-slack overhead electric wires, it would be necessity to use expensive alloys such as invar (a nickel alloy) so as to meet the requirement for a low linear expansion coefficient.

SUMMARY OF INVENTION

An object of the present invention is to provide a twisted conductor which eliminates the above-described problems and provides high-strength light-weight electric wires.

The above object of the present invention is accomplished by a high-strength light-weight twisted conductor comprising a central wire and a plurality of conductor wires concentrically twisted around the central wire, wherein the central wire is at least one high-strength wire made of a fiber-reinforced metal matrix composite.

The object of the invention is also accomplished by a twisted and compressed conductor comprising a central wire and a plurality of wires concentrically twisted around the central wire, wherein the central wire is at least one high-strength wire made of a fiber-reinforced metal matrix composite.

Application of the high-strength light-weight twisted conductor of the invention to a power cable makes it possible to extend the distance between pylons and considerably reduce cable breakage in the strong wind.

Application of the high-strength light-weight twisted conductors of the invention in the automotive field, etc. makes it possible to reduce the diameter of wire harnesses and completely prevent accidental wire breakage during routing.

In a highly preferred embodiment of the invention, the central wire is made of a non-iron material so that such problems as a core loss, corrosion and heat generation can be solved. The conductor according to this embodiment is particularly suited for use in power transmission and provides low-slack overhead electric wires without needing expensive alloys such as invar.

BRIEF DESCRIPTION OF DRAWINGS

FIG. 1 schematically shows an example of a coated electric wire having the twisted conductor of the invention, in which:

FIG. 4 schematically shows an example of a coated electric wire having the twisted and compressed conductor of the invention, in which:

FIG. 5(*b*) schematically shows another example of the twisted conductor of the invention (loose type).

DETAILED DESCRIPTION OF PREFERRED EMBODIMENTS

Figure 1A:
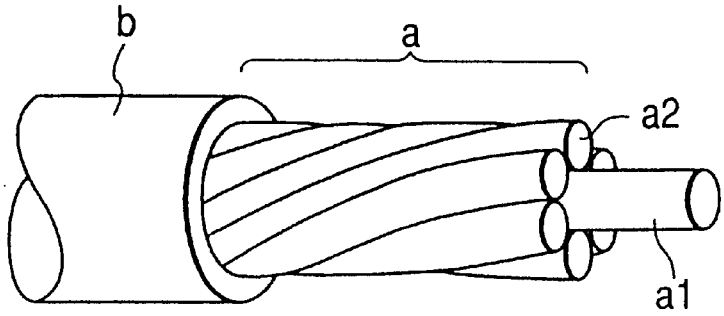
FIG. 1A is a perspective cutaway view of the coated electric wire.

The reinforcing fiber in the fiber-reinforced metal matrix composite, which constitutes the high-strength wire as a central wire, should be such as to provide a wire having higher strength and higher elasticity than other wires when combined with a matrix metal into a composite material.

Such fiber includes strands of inorganic fibers (ceramic fibers), such as graphite fiber, carbon fiber, silicon carbide fiber, silica fiber, alumina fiber, and boron fiber, and metallic fibers, such as copper fiber. While these fibers may be used as twisted or braided, it is usually desirable to use fibers in the form of a strand, taking it into consideration that the matrix metal should penetrate into the interstices among individual fibers in order for the fibers to perform their function to the full.

The reinforcing fiber is preferably selected as to exhibit particularly high strength and to have a maximum elongation of 2% or less when combined with a matrix metal into a composite and thereby to be an optimum central wire of low-slack overhead electric wires.

In case where the matrix metal is a low-melting metal such as Wood's alloy, the reinforcing fiber to be used can be chosen from organic or inorganic fibers that are not deteriorated or softened at the melting point of the metal, such as polyimide fiber or glass fiber.

Since metallic fibers mainly comprising iron, such a stainless steel wires, music wires, and steel wires, undergo a so-called core loss, the reinforcing fiber to be used in the twisted conductors for power transmission should be selected from inorganic fibers, organic fibers, and non-iron metals, and combinations thereof, namely, non-iron reinforcing fibers.

The matrix metal is appropriately selected from those capable of providing a high-strength and light-weight central wire. The metallic materials of choice include single metals, such as copper, aluminum, iron, silver, lead, tin, and magnesium; and their alloys. In making a choice, such a metallic material that impairs the performance of the reinforcing fiber in preparing a composite should be avoided.

Non-iron metals, particularly aluminum or aluminum alloys are advantageous as a matrix metal in that (1) no core loss occurs, (2) heat generation associated with an iron or an iron alloy material is prevented, and (3) the central wire itself exhibits relatively high electrical conductivity, which allows a further reduction of the diameter of the conductor as a whole or contributes to a reduction in power transmission loss.

The fiber-reinforced metal matrix composite can be prepared by, for example, melting the matrix metal, dipping the reinforcing fiber in the molten metal, and pulling up the fiber. In this preparation, a nozzle and the like can be used to obtain a composite with a desired thickness and a desired fiber content.

The high-strength light-weight twisted conductor of the invention should have the high-strength wire made of the fiber-reinforced metal matrix composite in its center. If the high-strength wire is at other position, it cannot perform its function to the full. The conductor wires surrounding the central wire can be of general conductors.

The central wire may be a single high-strength wire of the fiber-reinforced metal matrix composite or be composed of a plurality of the high-strength wires. In the latter case, the plurality of the high-strength wires may be either twisted or non-twisted. Where twisted, the individual wires would perform their function to the full. Further, the plurality of the high-strength wires can be compressed if desired.

Conductor wires made of copper, copper alloys, aluminum, alloys thereof, etc. are disposed around the central wire. It is desirable to arrange the conductor wires in such a manner that the central wire be at the exact center.

A customary apparatus for producing conventional twisted conductors, such as a single twister, a double twister, a rigid twister, etc., can serve as such for producing the high-strength light-weight twisted conductor of the invention. The pitch of twists, and the like are adjusted appropriately according to the desired performance.

The high-strength light-weight twisted conductor thus obtained is, in the practice, provided with an insulating coating layer, a semiconductor layer, and the like according to the use.

Such coated electric wires can be applied to not only small diameter wires used in automobiles but large diameter wires such as power cables, serving as high-strength light-weight coated wires in any application.

Since the conductor wires used in the twisted conductor, which surround the high-strength central wire made of the fiber-reinforced metal matrix composite, are common conductors, the electric wires comprising them can be treated in the same manner as for those comprising conventional twisted conductors when connected at the terminals by pressure bonding, soldering and the like, and the junctions are virtually equal to those of conventional wires in performance such as electrical resistance, strength, and so forth.

Having the high-strength wire made of the fiber-reinforced metal matrix composite at the center, the electric wire effectively enjoys the reinforcing effects of the high-strength wire. Additionally, the electric wire is very easy to handle because, when unwound, the curl is easily straightened.

An example of the electric wire having the twisted conductor of the present invention is shown in FIG. 1.

FIG. 1A is a cutaway view of an electric wire having the twisted conductor of the invention, in which a twisted conductor (a) is coated with an insulating layer (b) comprising a resin. The twisted conductor a comprises a central wire a1 which is a high-strength wire made of a fiber-reinforced metal matrix composite and six conductor wires a2 disposed concentrically and twisted helically around the central wire a1.

Figure 1B:
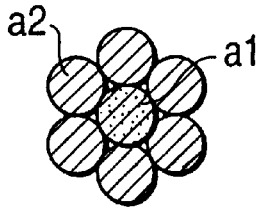
FIG. 1B is a cross section of the twisted conductor.

FIG. 1B is a cross section of the twisted conductor a shown in FIG. 1A.

Figure 1C:
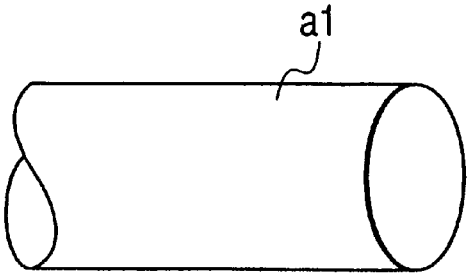
FIG. 1C is an enlarged view of the high-strength wire made of a fiber-reinforced metal matrix composite, used as a central wire.

FIG. 1C is an enlarged view of the high-strength wire a1 made of the fiber-reinforced metal matrix composite.

Figure 1D:
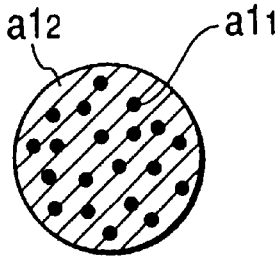
FIG. 1D is an enlarged cross-sectional view of the high-strength wire.

FIG. 1D is an enlarged cross-sectional view of the high-strength wire a1 made of the fiber-reinforced metal matrix composite. As can be seen, the high-strength wire a1 is made of a composite material composed of reinforcing fibers $a\mathbf{1}_1$ and a metal matrix $a\mathbf{1}_2$.

Figure 2:
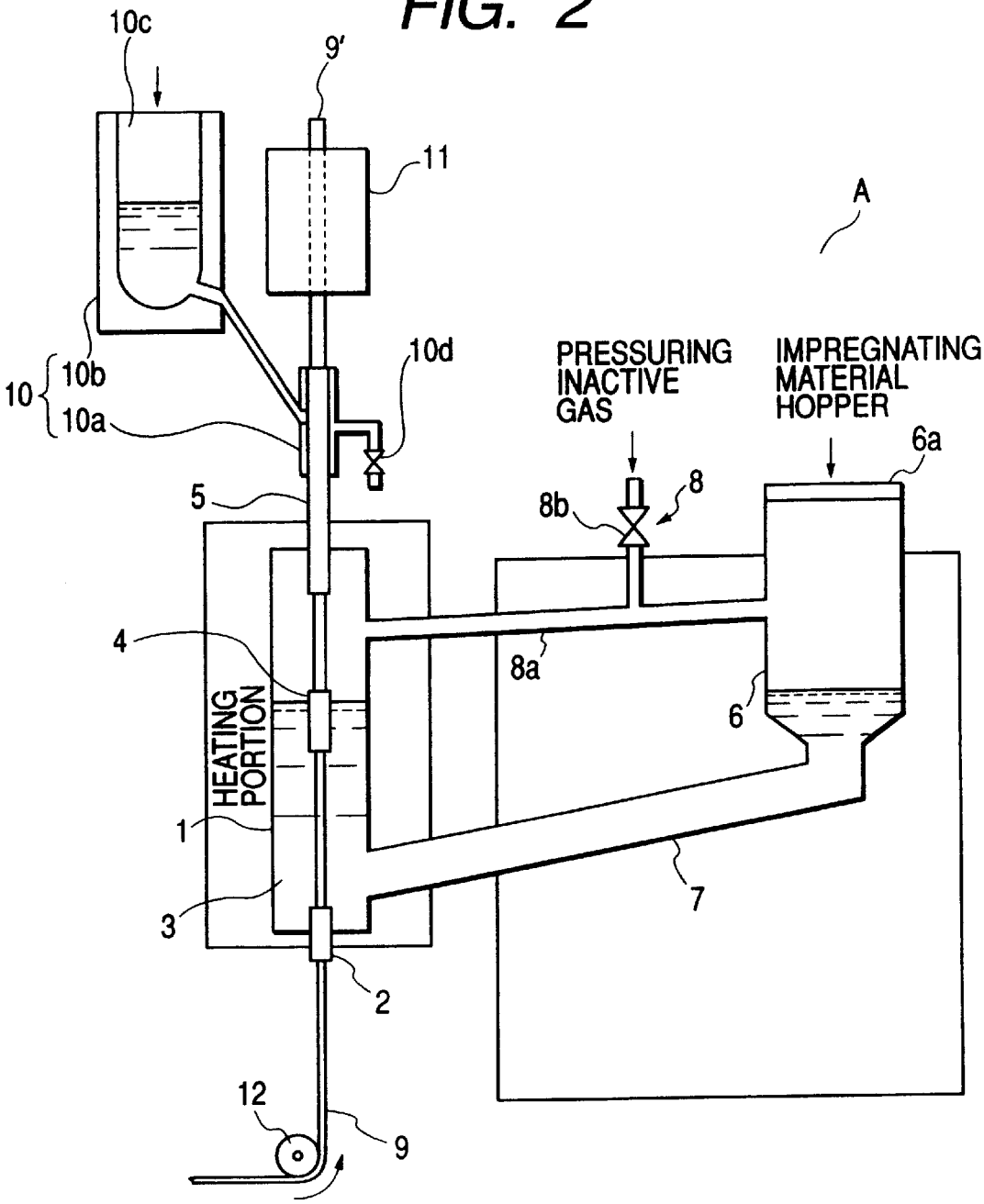
FIG. 2 shows an example of a melt impregnating apparatus which can be used to produce a fiber-reinforced metal matrix composite used in the invention.

The fiber-reinforced metal matrix composite which can be used in the invention can be produced by use of, for example, a melt impregnation apparatus A as shown in FIG. 2. The melt impregnating apparatus A comprises (1) an impregnating tank having an inlet sealing part at the bottom, an outlet sealing part at the top, and a drawing part between the inlet and the outlet sealing parts, (2) a raw material heating tank connected to the impregnating tank through a heating duct, and (3) a pressurizing means for maintaining the insides of the impregnating tank and the raw material heating tank in a pressurized state. By the use of the melt impregnating apparatus A, there is obtained a void-free (having no matrix-starved portions) fiber-reinforced metal matrix composite in which the individual fibers are in complete contact with the metal matrix and are therefore allowed to perform their full function.

In the melt impregnating apparatus A, the impregnating tank 1 has an inlet sealing part 2 at the bottom thereof and contains a molten metal 3 as a matrix material. The impregnating tank 1 has a drawing part 4 having a die on the liquid level of the molten metal 3, the upper portion of which is projected over the level of the molten metal 3, and an outlet sealing part 4 on the extension of the line connecting the inlet sealing part 2 and the drawing part 4. The impregnating tank 1 has a sufficient space above the drawing part 4.

The impregnating tank 1 and the raw material heating tank 6 are connected via the heating duct 7. The heating duct 7 is connected to the impregnating tank 1 at a position lower than the liquid level of the molten metal 3.

The raw material heating tank 6 is closed with a removable lid 6*a*, which is removed to make a feed opening 6*b* for feeding the raw material to the heating tank 6. The impregnating tank 1, the raw material heating tank 6, and the heating duct 7 are heated by means of heaters (not shown) so that their inside may be maintained at or above the melting point of the matrix metal.

A gas pipe 8*a* is connected to the impregnating tank 1 and the raw material heating tank 6 so that the insides of these tanks can be pressurized by a pressurizing means 8 comprising a pressure valve 8*b* and the gas pipe 8*a*. The pressurizing gas should be inert to the molten metal.

While not shown, the impregnating tank 1 and the raw material heating tank 6 are provided with pipes and valves leading to a vacuum line for displacement of the inside gas, with which the inside atmosphere can easily be displaced.

The melt impregnating apparatus A is designed to elevate the gas pressure up to about 30 kg/cm$^2$. While a linear material (a bundle of reinforcing fiber) 9 is continuously fed through the inlet sealing part 2, there is no leak of molten metal through the inlet sealing part 2 because the inner diameter of the inlet sealing part 2 is sufficiently small.

On the other hand, because the outlet sealing part 5 is sealed by small-diameter orifice seal to cause little gas leakage, and also because a sufficient amount of gas is supplied from the pressurizing means 8, the inner pressure of the impregnating tank 1 can be maintained high thereby producing a void-free composite which can exhibit the full performance of the reinforcing fiber.

The apparatus A can further have a metal coating means 10 for coating the linear composite continuously discharged from the impregnating tank 1 with a molten metal, the metal coating means 10 being positioned near the outlet sealing part 5 (in this particular example, the metal coating means 10 is in contact with the outlet sealing part 5). The metal coating means 10 comprises a coating furnace 10*a* and a heating part 10*b* from which a molten resin is supplied to the coating furnace 10*a*. While the coating metal may be either the same as or different from the matrix metal, it must have the same or a lower melting point than the matrix metal.

The metal coating means 10 prevents the reinforcing fibers from being exposed on the surface of the composite. Further, an appropriately selected coating metal would improve various properties of the composite, such as electrical conductivity and anti-corrosion.

The coating metal is supplied through a feed opening 10*c* into the heating part 10*b*, heat melted by a heater (not shown) fitted to the heating part 10*b*, and forwarded to the coating furnace 10*a* to coat the surface of the linear composite continuously pulled out of the outlet sealing part 5.

Where metal coating is not required or where the kind of the coating metal is exchanged, the molten metal is drained from the coating furnace 10*a* and the heating part 10*b* through a drain valve 10*d* fitted to the coating furnace 10*a*.

The fiber-reinforced metal matrix composite pulled out of the outlet sealing part 5 and, if desired, coated with a metal by the metal coating means 10 is sent to a cooling unit 11 set above the outlet sealing part 5 and on the extension of the line connecting the inlet sealing part 2 and the outlet sealing part 5, where the composite is forcibly cooled with liquid nitrogen.

A linear material 9, which is a reinforcing fiber core, is continuously fed from the right-hand side of FIG. 2, turned upward by a pulley 12, and introduced into the molten metal 3 in the impregnating tank 1 through the inlet sealing part 2. The linear material 9 is regulated into a desired thickness having a proper matrix content through the drawing part 4 and then continuously pulled out of the impregnating tank 1 through the outlet sealing part 5. If necessary, a metal coat is given to the surface of the molten resin-impregnated fiber by the metal coating means 10. The resin-impregnated fiber or the metal-coated resin-impregnated fiber is forcibly cooled in the cooling unit 11 to obtain a linear fiber-reinforced metal matrix composite 9' in a continuous manner.

By the use of the melt impregnating apparatus A described above, a void-free composite having excellent characteristics as theoretically expected can be produced with good productivity.

The aforementioned twisted conductor according to the present invention is applicable to a twisted and compressed conductor. The twisted and compressed conductor of the invention is freed of the problems of conventional twisted and compressed conductors.

A compressed conductor is formed by compressing a plurality of twisted conductor wires in a die. On being compressed, the wires reduce the total outer diameter and have the whole cross section shaped into a circular or a nearly circular form, which leads to a reduction in a required thickness of the insulating coating layer. As a result, compression achieves a great reduction of the total diameter.

Figure 3:
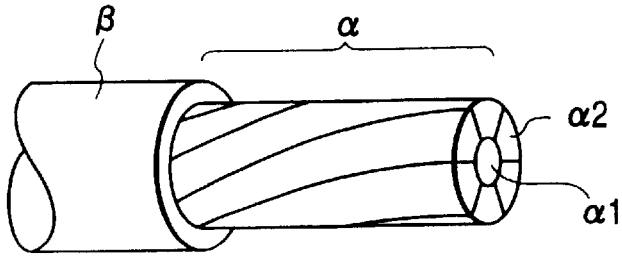
FIG. 3 schematically shows a coated electric wire having a conventional twisted and compressed conductor.

A coated electric wire having a conventional compressed conductor is schematically illustrated in FIG. 3, in which reference $\alpha$ indicates a compressed conductor comprised of, in this particular example, seven conductor wires. One wire out of seven is a central wire $\alpha$1, and the other six wires $\alpha$2 are concentrically twisted around the central wire $\alpha$1. The compressed conductor has a nearly circular cross section. An insulating resin layer $\beta$ is provided around the compressed conductor.

An electric wire having a compressed conductor has a character that it is not as easy to bend as one having a non-compressed conductor. This could be coped with to some extent by adjusting the winding tension in spooling. However, the wire having a compressed conductor has another character that it is difficult to straighten after once curled or bent.

Therefore, the electric wire remains curled after unwinding from the spool. A stress relaxing apparatus has been used to straighten a curled electric wire, particularly a thick one such as a power cable. In such an apparatus, however, the electric wire is passed over a number of pulleys for stress relaxation, incurring a high possibility of receiving scratches on the conductor which could be a quality problem.

Similar problems are involved even in cases where the compressed conductor is applied to small-diameter electric wires as used in automobiles.

In automobile assembly, for example, a bundle of electric wires are routed in the form of a wire harness formed on a wire arrangement board having fasteners such as hooks and bars. Where the electric wires having conventional compressed conductors are once bent at the hooks or bars on the wire arrangement board, the shape of the bend is set even when the bend radius is fairly large, which interferes with successive operations such as taping and grommet fitting.

The above-described disadvantages of conventional twisted and compressed conductor can be eliminated by using the twisted and compressed conductor of the invention in which a plurality of conductor wires are concentrically twisted around a high-strength central wire made of a fiber-reinforced metal matrix composite.

Compression of the twisted conductor can be carried out by the use of an apparatus commonly employed for producing conventional twisted and compressed conductors, i.e., a compression die (diamond draw die) and the like.

It is essential for the twisted and compressed conductor of the invention that the high-strength wire made of a fiber-reinforced metal matrix composite be positioned at the center. Otherwise the high-strength wire fails to perform its full function.

An insulating coating layer, a semiconductor layer and the like are then provided around the twisted and compressed conductor according to necessity. The coated electric wire is applicable to not only small-diameter electric wires for automotive use but large-diameter electric wires such as power cables.

The twisted wires having the fiber-reinforced metal matrix composite as a central wire show higher compressibility and are therefore made smaller and more circular in the cross section than those having an ordinary conductor wire as a central wire. As a result, the requisite thickness of the coating resin can be reduced, and the total outer diameter can be reduced greatly.

In practice, the twisted and compressed conductor thus obtained is provided with an insulating coating layer, a semiconductor layer and the like according to necessity. The coated electric wire is applicable to not only small-diameter electric wires for automotive use but large-diameter electric wires such as power cables. In these applications the coated electric wire hardly takes a permanent set in winding or bending.

Similarly to the coated wires comprising the twisted conductors of the invention, the coated wires comprising the twisted and compressed conductors are ready to have higher strength and lighter weight. Further, since they have a fiber-reinforced metal matrix composite as a central wire, they can be made finer than those using conventional twisted and compressed conductors. Accordingly, they are extremely suitable in various applications including electric wires used in automobiles as well as power cables.

Because the wires disposed around a central wire in the twisted and compressed conductor of the invention are common conductor wires and also because this structure of wire arrangement, being compressed, is securely retained at cut ends, the electric wires comprising them can be treated in completely the same manner as for those comprising conventional twisted conductors when connected at the terminals by pressure bonding, soldering and the like, and the junctions are virtually equal to those of conventional electric wires in performance such as electrical resistance, strength, and so forth.

Having a high-strength wire as a central wire, the twisted and compressed conductors of the invention provide electric wires with higher strength than those comprising conventional twisted and compressed conductor. A proper choice of the matrix metal would make such electric wires still lighter. Thus, high-strength light-weight electric wires will be provided with ease.

An illustrative example of the electric wires having the twisted and compressed conductor of the invention is shown in FIG. 4. FIG. 4A is an electric wire having the twisted and compressed conductor of the invention, in which a twisted and compressed conductor a' is coated with an insulating resin layer b'. The twisted and compressed conductor a' comprises a central wire a1', which is a high-strength wire made of a fiber-reinforced metal matrix composite, and concentric six conductor wires a2' twisted helically around the central wire a1'.

Figure 4A:
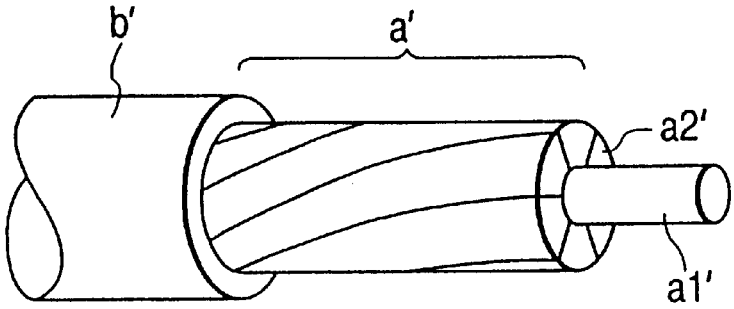
FIG. 4A is a perspective cutaway view of the coated electric wire.
Figure 4B:
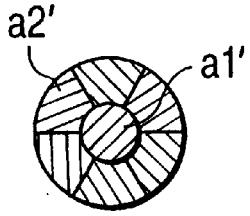
FIG. 4B is a cross section of the twisted and compressed conductor.

FIG. 4B is a cross section of the twisted and compressed conductor a' shown in FIG. 4A.

Figure 4C:
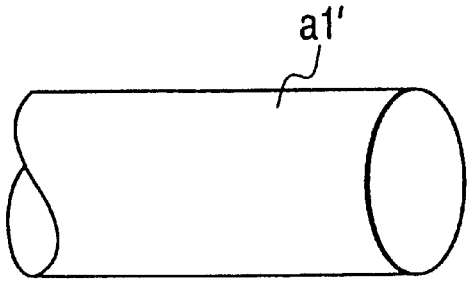
FIG. 4C is an enlarged view of the high-strength wire made of a fiber-reinforced metal matrix composite, used as a central wire.

FIG. 4C is an enlarged view of the high-strength wire a1' made of the fiber-reinforced metal matrix composite.

Figure 4D:
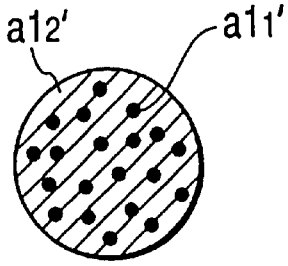
FIG. 4D is an enlarged cross-sectional view of the high-strength wire.

FIG. 4D is an enlarged cross-sectional view of the high-strength wire a1' made of the fiber-reinforced metal matrix composite. As can be seen, the high-strength wire a1' is a composite material composed of reinforcing fibers a$\mathbf{1}_1$' and a metal matrix a$\mathbf{1}_2$'.

Figure 5A:
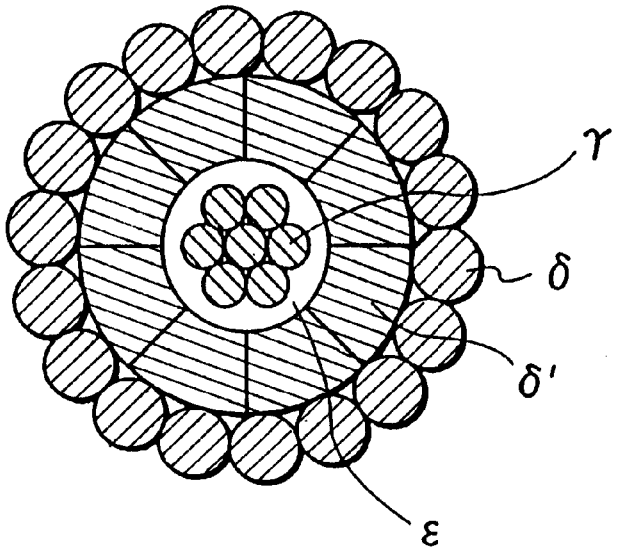
FIG. 5(*a*) schematically shows an example of the twisted conductor of the invention (gap type).

In FIG. 5A is shown another example of the high-strength light-weight twisted conductors of the present invention. The conductor of FIG. 5A comprises a plurality of conductor wires (δ) concentrically arranged and twisted around a central wire, some of the conductor wires having been compressed (indicated by symbols δ'). The central wire is made up of a plurality of intertwined high-strength wires γ each made of a fiber-reinforced metal matrix composite. The conductor according to this embodiment is the most suitable for use in low-slack overhead electric wires.

The structure shown is of a so-called gap type, in which a gap _ is provided between the central wire and the surrounding conductor wires δ and δ' so that the conductor wires δ and δ' may share no or reduced tensile force. The above-described type of conductors having some of the conductor wires compressed are included under the category of the high-strength light-weight twisted conductors of the present invention.

Figure 5B:
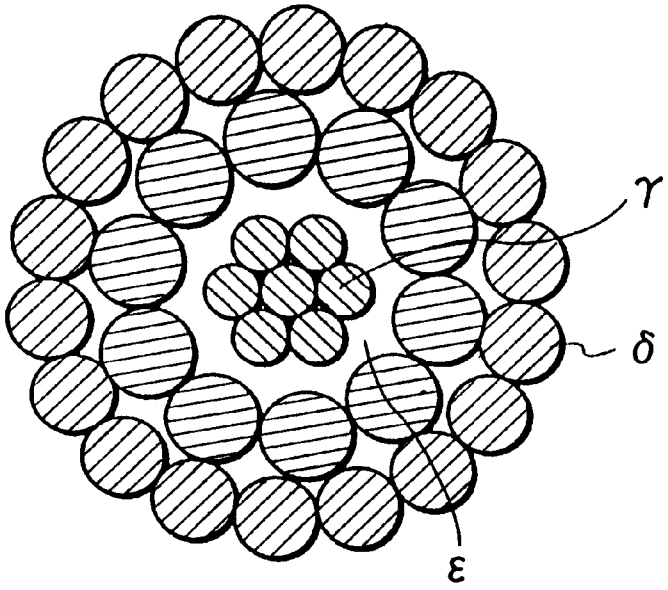

In FIG. 5B is shown still another example of the high-strength light-weight twisted conductor of the invention. The conductor of FIG. 5B comprises a plurality of conductor wires δ concentrically arranged and twisted around a central wire, the central wire being made up of a plurality of intertwined high-strength wires γ each made of a fiber-reinforced metal matrix composite. The conductor according to this embodiment is also the most suitable for use in low-slack overhead electric wires. The structure shown is of a so-called loose type, in which a gap _ is provided between the central wire and the surrounding conductor wires δ so that the conductor wires δ may share no or reduced tensile force similarly to the gap type.

According to the embodiments shown in FIGS. 4 and 5, since the friction between the central wire and the surrounding conductor wires is lessened by the gap _ therebetween, the electric wires having these conductors can be laid under tension by holding only the central wire thereof, with the surrounding conductor wires sharing no or little tensile force. Where the materials of the high-strength central wire are so selected as to have a lower linear expansion coefficient than the conductor wires, the slack of the electric wire in a higher temperature atmosphere than the temperature of wire laying is decided only by the slack of the central wire.

The high-strength light-weight twisted conductor according to the invention provides high-strength light-weight electric wires and is applicable to small diameter electric wires used in automobiles, etc. as well as large diameter electric wires such as power cables.

The twisted and compressed conductor according to the invention provides electric wires which have high strength and light weight and yet can have a very small thickness according to use and hardly takes such a permanent set in winding or bending as has been observed with electric wires having a conventional twisted and compressed conductor. The twisted and compressed conductor of the invention is therefore applicable to not only small diameter electric wires used in automobiles, etc. but large diameter electric wires such as power cables.

Where both the reinforcing fibers and the metal matrix of the fiber-reinforced metal matrix composite are made of non-iron materials, the twisted conductor and the twisted and compressed conductor of the present invention are freed of corrosion and a core loss and provide electric wires suitable as power cables, particularly low-slack overhead electric wires.

What is claimed is:

1. A high-strength light-weight twisted conductor comprising:

a central wire; and a plurality of conductor wires concentrically twisted around the central wire, wherein said central wire is at least one high-strength wire including (1) composite material having a metal matrix and a reinforcing fiber and (2) a highly conductive metal coating surrounding said composite material; and said central wire directly contacts said plurality of conductor wires.

2. The high-strength light-weight twisted conductor according to claim 1, wherein said reinforcing fiber is a non-iron reinforcing fiber, and said metal matrix is a non-iron metal.

3. A twisted and compressed conductor comprising:

a central wire; and a plurality of conductor wires concentrically twisted around the central wire, wherein said central wire is at least one high-strength wire including (1) a composite material having a metal matrix and a reinforced fiber and (2) a highly conductive metal coating surrounding said composite material; and said central wire directly contacts said plurality of conductor wires.

4. The twisted and compressed conductor according to claim 3, wherein said reinforced fiber is a non-iron reinforcing fiber, and said metal matrix is a non-iron metal.

* * * * *